US009739033B2

(12) United States Patent
Thompson

(10) Patent No.: US 9,739,033 B2
(45) Date of Patent: Aug. 22, 2017

(54) ROTARY DITCHER ATTACHMENT FOR AN EXCAVATOR

(71) Applicant: Dynamic Ditchers Inc., Dugald (CA)

(72) Inventor: Mark Christopher Thompson, Dugald (CA)

( * ) Notice: Subject to any disclaimer, the term of this patent is extended or adjusted under 35 U.S.C. 154(b) by 0 days.

(21) Appl. No.: 14/943,791

(22) Filed: Nov. 17, 2015

(65) Prior Publication Data

US 2016/0138241 A1 May 19, 2016

Related U.S. Application Data

(60) Provisional application No. 62/080,614, filed on Nov. 17, 2014.

(51) Int. Cl.

| | |
|---|---|
| ***E02F 5/08*** | (2006.01) |
| ***E02F 9/22*** | (2006.01) |
| ***E02F 3/36*** | (2006.01) |
| ***E02F 5/28*** | (2006.01) |

(52) U.S. Cl.
CPC ..... *E02F 5/08* (2013.01); *E02F 3/3654* (2013.01); *E02F 5/282* (2013.01); *E02F 9/2221* (2013.01)

(58) Field of Classification Search
CPC ..... E02F 5/08; E02F 3/18
USPC ..... 37/242, 352, 403, 468, 92, 365
See application file for complete search history.

(56) References Cited

U.S. PATENT DOCUMENTS

| | | | | |
|---|---|---|---|---|
| 1,762,441 A | | 6/1930 | Johnson | |
| 1,858,360 A | * | 5/1932 | Cruse | E02F 3/188 172/122 |
| 2,942,360 A | | 6/1960 | Hawkins et al. | |
| 3,104,481 A | * | 9/1963 | George | E02F 3/142 37/352 |
| 3,645,020 A | | 2/1972 | Beslin et al. | |
| 4,459,767 A | | 7/1984 | Cartner | |
| 4,506,464 A | * | 3/1985 | Cartner | A01D 34/866 172/260.5 |
| 4,542,940 A | * | 9/1985 | Marten | E02F 3/188 173/8 |
| 4,612,715 A | | 9/1986 | Cartner | |
| 4,712,320 A | * | 12/1987 | Cartner | E02F 3/186 172/108 |
| 4,913,681 A | * | 4/1990 | Green | F16D 3/185 464/154 |

(Continued)

FOREIGN PATENT DOCUMENTS

| | | | | |
|---|---|---|---|---|
| BE | EP 1972724 B1 | * | 3/2014 | E02F 3/8825 |
| BE | EP 2743406 A1 | * | 6/2014 | E02F 3/245 |
| EP | 1319761 | | 4/2010 | |

*Primary Examiner* — Matthew D Troutman
(74) *Attorney, Agent, or Firm* — Ryan W. Dupuis; Kyle R. Satterthwaite; Ade & Company Inc.

(57) ABSTRACT

A rotary ditcher attachment is selectively mounted onto the bottom of an excavator implement. The rotary ditcher attachment has an attachment frame including a mounting bracket for releasable mounting onto a tool mount on the boom of the excavator implement. A rotary disc assembly on the attachment frame includes a rotor supported for rotation relative to the attachment frame about a disc axis, and a plurality of blades supported on the rotor for cutting into the ground as the rotor is rotated. A drive motor for driving rotation of the rotor relative to the attachment frame is supported on the attachment frame so as to be releasable from the boom together with the attachment frame.

18 Claims, 4 Drawing Sheets

(56) References Cited

U.S. PATENT DOCUMENTS

| | | | | | |
|---|---|---|---|---|---|
| 5,101,583 | A * | 4/1992 | Scordilis | E02F 5/282 | 299/39.8 |
| 5,113,610 | A * | 5/1992 | Liebrecht, Jr. | A01B 13/00 | 37/189 |
| 6,017,169 | A * | 1/2000 | Toor | A01B 33/02 | 111/118 |
| 6,230,770 | B1 * | 5/2001 | Spaargaren | A01G 23/067 | 144/24.12 |
| 6,336,280 | B1 | 1/2002 | Haigh | | |
| 6,349,488 | B1 * | 2/2002 | Mason | E02F 3/20 | 37/189 |
| 6,438,874 | B1 * | 8/2002 | LaBounty | E02F 3/20 | 144/24.12 |
| 7,096,609 | B2 * | 8/2006 | Bainter | E02F 3/10 | 37/352 |
| 7,748,421 | B2 * | 7/2010 | Everett | A01G 3/002 | 144/172 |
| 9,462,759 | B2 * | 10/2016 | Knipp | A01G 23/06 | |

* cited by examiner

ROTARY DITCHER ATTACHMENT FOR AN EXCAVATOR

This application claims the benefit under 35 U.S.C. 119(e) of U.S. provisional application Ser. No. 62/080,614, filed Nov. 17, 2014.

FIELD OF THE INVENTION

The present invention relate to a rotary ditcher attachment supporting a rotary cutting disc thereon for cutting into the ground to form a ditch, and more particularly the present invention relates to a rotary ditcher attachment which is particularly suited for mounting onto the boom of an excavator implement in place of an excavator bucket.

BACKGROUND

It is common to provide ditches alongside roadways and the like to direct water away from roads and properties. Over time, such ditches can be filled with sediment or dirt and the like which is washed into the ditch by precipitation. Accordingly, it is desirable to periodically clear existing ditches to maintain flow capacity therein. It is further desirable on occasion to create new and/or deeper ditches where necessary to accommodate different water flows.

One common tool for clearing ditches is an excavator with a bucket supported on the end of a boom, but clearing ditches in this manner is a long and tedious task when clearing long lengths of ditches. Also bucket excavators tend to remove dirt in full buckets which then require suitable disposal.

In view of the above, various ditching devices have been developed which use a rotary disc. Examples of such devices can be found in European patent 1319761 by Greffet et al. and U.S. Pat. No. 4,459,767 by Cartner, U.S. Pat. No. 6,336,280 by Haigh, U.S. Pat. No. 3,645,020 by Beslin et al., U.S. Pat. No. 4,612,715 by Cartner, U.S. Pat. No. 1,762,441 by Johnson and U.S. Pat. No. 2,942,360 by Hawkins et al. Known devices however tend to be large and cumbersome and are not readily adaptable to commonly available bucket excavators of the type used for clearing ditches in many instances.

SUMMARY OF THE INVENTION

According to one aspect of the invention there is provided a rotary ditcher attachment for an implement having an implement frame supported for movement along the ground, a boom extending between a first end pivotally supported on the implement frame and a second end opposite the first end, and a tool mount supported on the second end of the boom for supporting a ground engaging tool thereon, the rotary ditcher attachment comprising:

an attachment frame;

a mounting bracket supported on the attachment frame and arranged for releasable mounting onto the tool mount of the implement so as to be arranged to selectively suspend the attachment frame on the second end of the boom;

a rotary disc assembly comprising:

a rotor supported on the attachment frame for rotation relative to the attachment frame about a disc axis; and a plurality of blades supported on the rotor and arranged for cutting into the ground as the rotor is rotated; and a drive motor coupled to the rotor to drive rotation of the rotor relative to the attachment frame, the drive motor being supported on the attachment frame so as to be releasable from the boom together with the attachment frame.

The rotary ditcher attachment is particularly suited for use with an implement comprising an excavator in which the tool mount is arranged to support an excavator bucket thereon and in which the attachment frame is arranged to be interchangeable with the excavator bucket. More particularly, the rotary ditcher attachment is suited for an implement having a tool mount that is pivotal relative to the boom about a tool axis. In this instance, the attachment frame is preferably arranged to be supported on the tool mount such that the attachment frame is pivotal with the tool mount relative to the boom about the tool axis and such that the disc axis is parallel to the tool axis.

By supporting a rotary cutting disc on an attachment frame which is readily attachable to the boom of an existing excavator implement, ditches can be cleared much more efficiently as compared to the use of an excavator bucket, while being much more reliable and cost effective than larger and more complex ditching devices described in the prior art.

Preferably the rotary ditcher attachment further includes a guard panel having an inner side portion and an upper portion supported on the attachment frame to extend circumferentially about an inner side and a top side of the rotor of the rotary disc assembly respectively.

Preferably the rotor is driven to rotate in a direction corresponding to a bottom side of the rotor being displaced away from the inner side portion of the guard panel.

The upper portion of the guard panel may be pivotal relative to the inner side portion and the attachment frame about an axis at an inner end of the upper portion such that an opposing free outer end of the upper portion is movable between a closed position in proximity to an outer side of the rotor and an open position spaced above the rotor such that the outer side of the rotor is substantially unobstructed by the upper portion of the guard panel.

Preferably at least one of the blades comprises a cupped front blade having a main body protruding forwardly from the rotor generally in an axial direction from an inner end to an outer end of the blade in which at least an outer portion of the main body is angled to extend outwardly at slope leading into a direction of rotation of the rotor such that the outer end of the blade leads the inner end of the blade in the direction of rotation of the rotor.

The plurality of blades may include a plurality of front blades supported at a front side of the rotor and a plurality of rear blades supported at a rear side of the rotor opposite from the front side of the rotor in a direction of the disc axis of the rotor. In this instance, a collective area of leading faces of the front blades is preferably greater than a collective area of leading faces of the rear blades, for example by arranging each rear blade to be smaller in size than each front blade.

Preferably at least one of the rear blades also comprises a cupped blade having a main body protruding rearwardly from the rotor generally in an axial direction from an inner end to an outer end of the blade in which at least an outer portion of the main body is angled to extend outwardly at slope leading into a direction of rotation of the rotor such that the outer end of the blade leads the inner end of the blade in the direction of rotation of the rotor.

Preferably the drive motor and the rotary disc assembly are spaced apart from one another in a direction of the disc axis so as to be situated on the attachment frame at axially opposing sides of the mounting bracket.

The drive train of the rotary disc assembly may further comprise a resilient damper connected in series with a drive shaft connecting the drive motor to the rotary disc assembly.

According to one embodiment, the drive motor comprises a hydraulic motor coupled to the rotor that includes a hydraulic input arranged to be coupled to a hydraulic supply of the implement. The hydraulic input preferably includes: i) couplers arranged to permit ready separation of the hydraulic motor from the hydraulic supply of the implement; ii) a variable control valve associated with the hydraulic input of the drive motor so as to be arranged to controllably vary a flow rate of the hydraulic supply of the implement so as to vary a speed of rotation of the rotor; and/or iii) a pressure relief valve associated with the hydraulic input of the drive motor so as to be arranged to relieve pressure in the hydraulic supply of the implement above a prescribed upper pressure limit.

According to an alternative embodiment, the drive motor comprises an internal combustion engine. In this instance, a gearbox is preferably connected in series between the drive motor and the rotary disc assembly. The gearbox may comprise a planetary reducer connected coaxially with the disc axis and an output axis of the drive motor.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
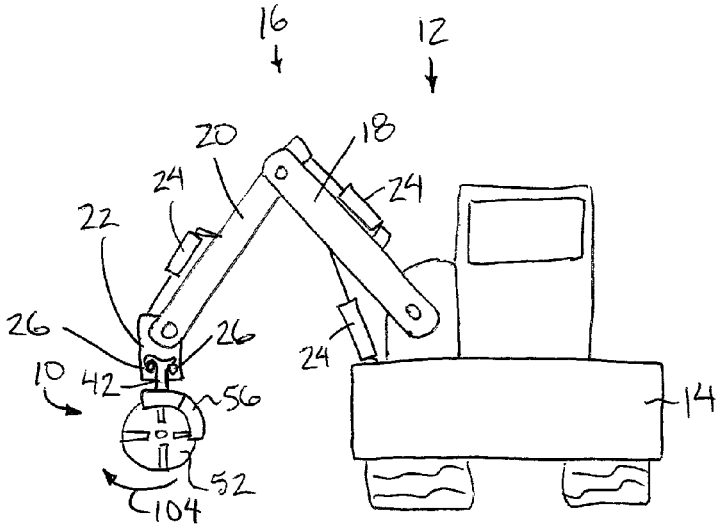
FIG. 1 is a front elevational view of an excavator implement supporting the rotary ditcher attachment thereon.
Figure 2:
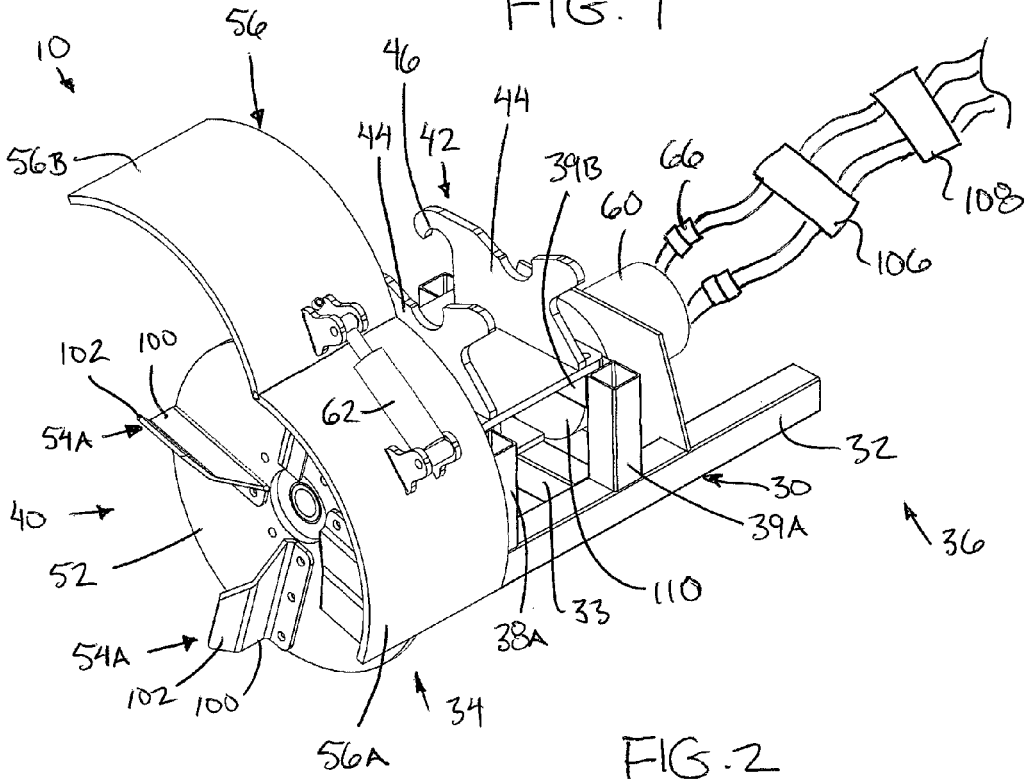
FIG. 2 is a perspective view of the rotary ditcher attachment according to FIG. 1, shown separated from the excavator implement.
Figure 3:
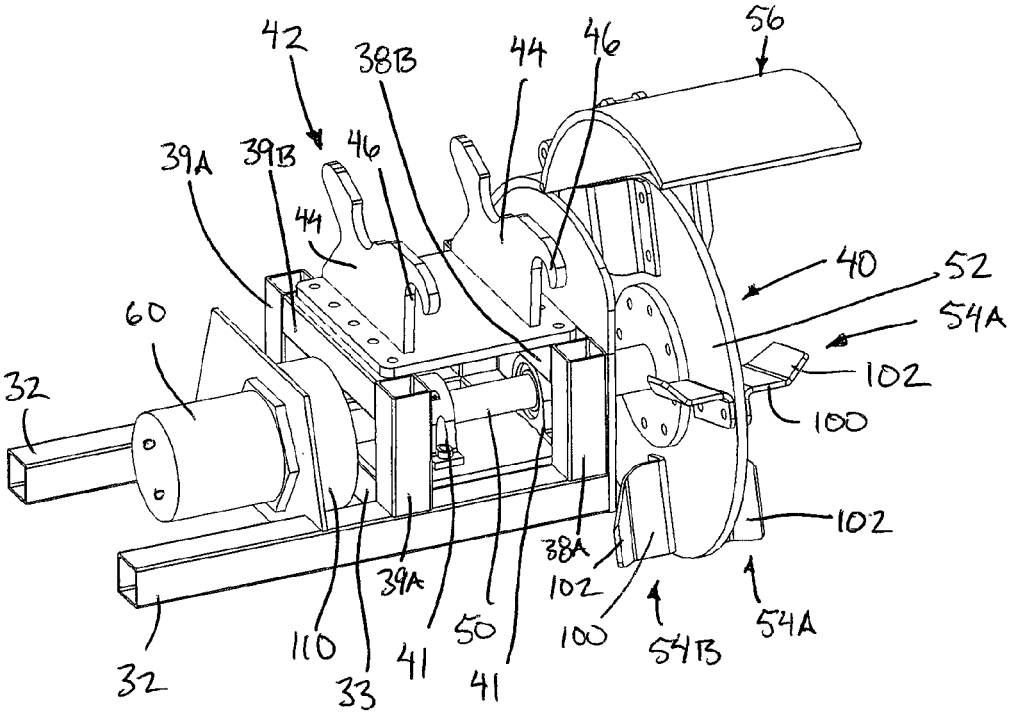
FIG. 3 is another perspective view of the rotary ditcher attachment according to FIG. 1.
Figure 4:
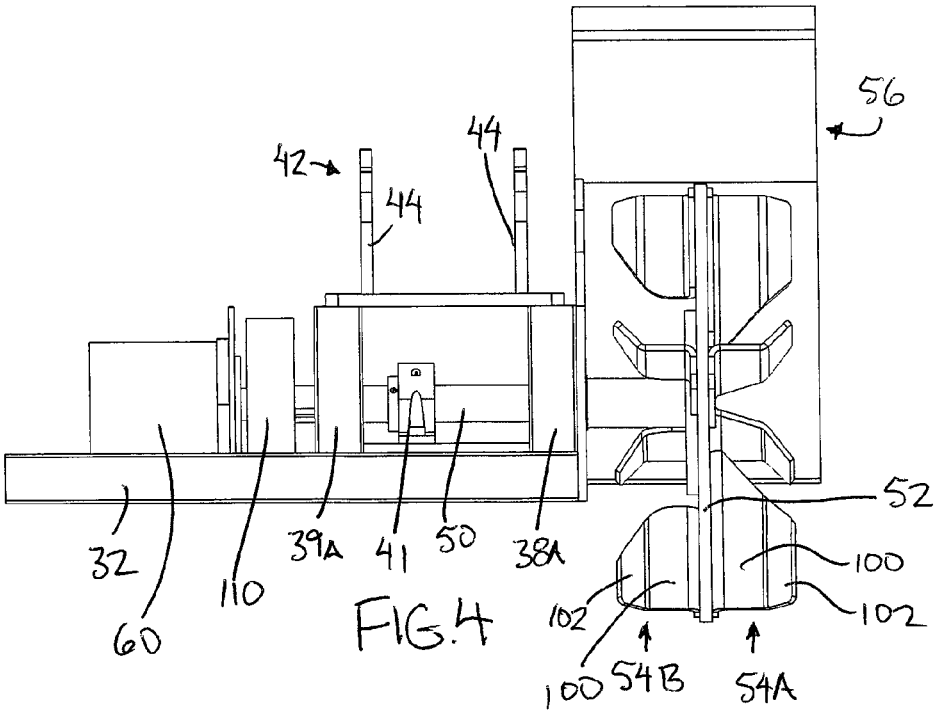
FIG. 4 is a left side elevational view of the rotary ditcher attachment according to FIG. 1.
Figure 5:
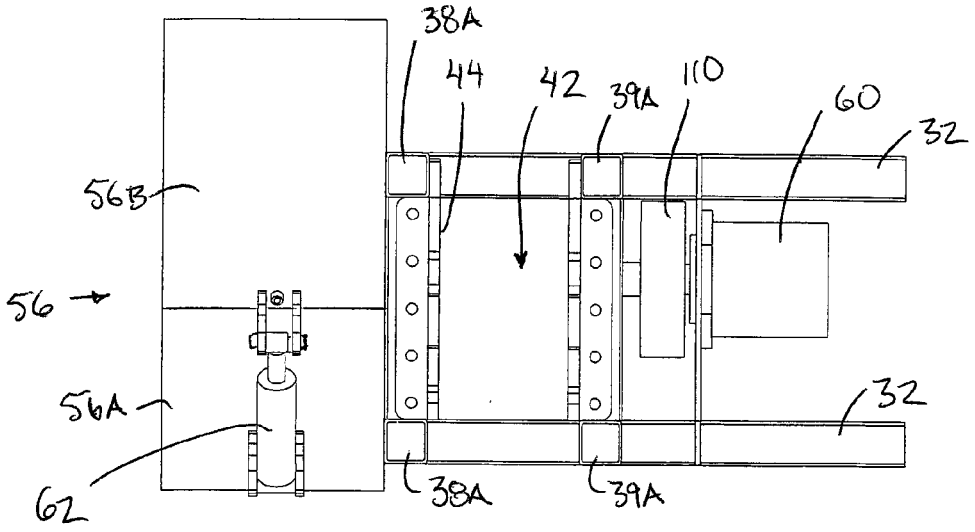
FIG. 5 is a top plan view of the rotary ditcher attachment according to FIG. 1.
Figure 6:
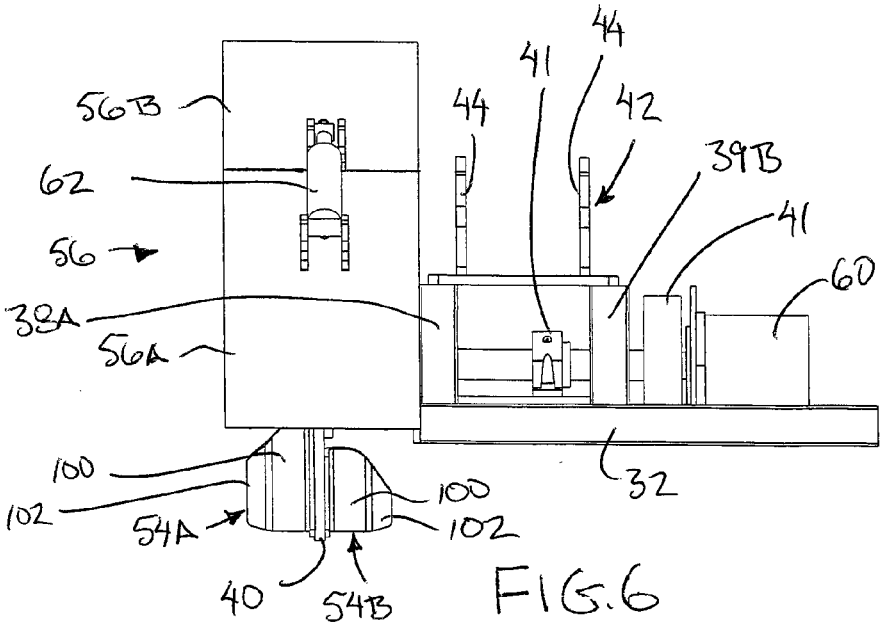
FIG. 6 is a right side elevational view of the rotary ditcher attachment according to FIG. 1.
Figure 7:
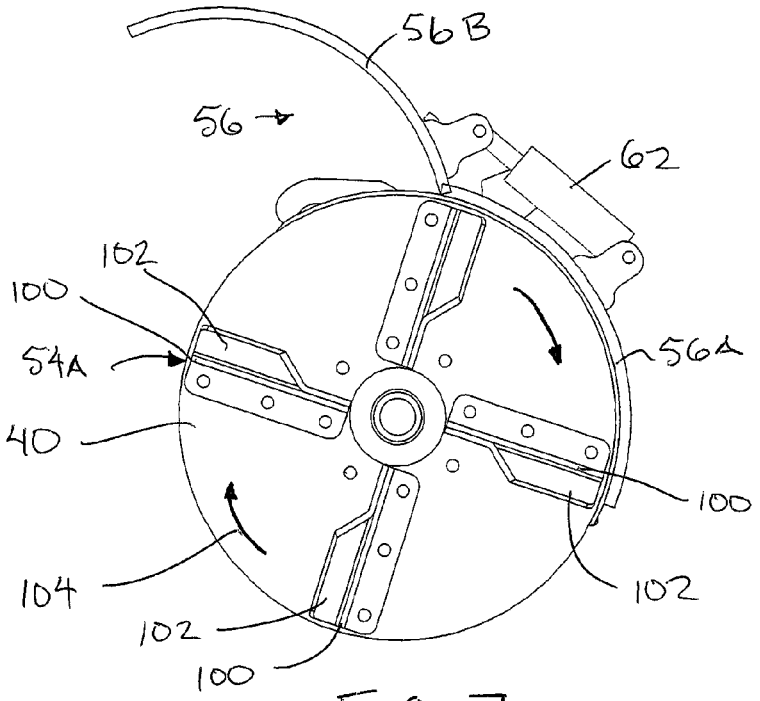
FIG. 7 is an enlarged front end elevational view of the rotary ditcher attachment according to FIG. 1.

Referring to the accompanying figures there is illustrated a rotary ditcher attachment 10 which is particularly suited for use with an excavator-type implement 12. Although two embodiments are shown in the accompanying figures, the common features of the various embodiments will first be described.

A typical excavator implement 12 includes a frame 14 supported on wheels or tracks for rolling movement in a forward working direction. A boom 16 is supported on the frame extending generally between longitudinally opposed first and second ends. More particularly, the boom 16 includes a first section 18 at the first end of the boom, which is pivotally supported on the excavator frame. A second section 20 of the boom is in turn pivotally supported on the first section opposite from the frame to span from the first section to the second end of the boom.

A tool mount 22 is pivotally supported on the second end of the boom, at the end of the second section 20 opposite from the first section 18. Hydraulic actuators 24 are provided for controlling pivotal movement of the first section relative to the excavator frame, the second section relative to the first section, and the tool mount relative to the second section respectively.

The tool mount 22 according to one example may include a pair of spaced apart mounting pins 26 onto which an excavator bucket can be hooked and selectively retained, typically by use of a latch mechanism. In further embodiment, the tool mount may take other configurations which still readily permit a bucket or other tools to be readily supported thereon such that the tools remains selectively separable from the boom as desired.

In each instance of the rotary ditcher attachment 10, there is provided an attachment frame 30 having a base formed by two rail members 32 spanning parallel and spaced apart from one another to extend along the bottom side of the frame in a longitudinal direction between a front first end 34 and an opposing rear second end 36. The rail members 32 define laterally opposed inner and outer sides of the frame. cross members 33 join laterally between the rail members 32 of the base.

An upright frame portion 38 is provided at the first end of the frame in the form of two posts 38A in a common plane perpendicular to the longitudinal direction which extend upwardly from the rail members 32 respectively at opposing sides of the frame. The upright frame portion 38 also includes a first cross bar 38B connected between top ends of the two posts 38A.

An intermediate frame portion 39 is provided at an intermediate location in the form of two posts in a common plane perpendicular to the longitudinal direction which extend upwardly from the rail members 32 at opposing sides of the frame. The intermediate frame portion 39 also includes a second cross bar 39B connected between top ends of the two posts 39A so as to lay in common horizontal plane with the first cross bar 38B.

A mounting bracket 42 is provided on the frame 30 to be selectively attached to the two crossbars 38B and 39B using threaded fasteners. The bracket 42 is specific to one configuration of tool mount 22 of the excavator, but can be readily interchanged with a different configuration of mounting bracket to accommodate different excavator tool mounts as may be desired. The bracket 42 in the exemplary embodiment has two upright frame members 44 extending upwardly from the base member 32 at intermediate locations between the first and second ends. The two uprights extend upwardly generally parallel and longitudinally spaced from one another and define a respective hooks 46 arranged for hooking onto the mounting pins 26 of the tool mount of the excavator.

A latch may be further provided on the uprights for selectively latching the hooks relative to the mounting pins 26 such that the mounting bracket serves to couple the attachment frame 30 to the tool mount of the excavator in fixed relation to one another such that the attachment frame is pivotal relative to the boom 16 together with the tool mount.

Different configurations of hooks and/or latch arrangements may be provided in further embodiments to accommodate different manufacturer's arrangements of attachment connectors which permit various tools to be attached and readily disconnected from the tool mount of the boom.

A rotary disc assembly 40 is rotatably supported on the frame using a pair of axially spaced apart annular bearings 41 supported directly above the base of the frame defined by the rail members 32. More particularly, the rotary disc assembly 40 includes a shaft 50 which extends in the longitudinal direction of the attachment frame through the pair of bearings 41. The shaft 50 is supported by a first bearing 41 at the first end of the frame and a second bearing 41 at an intermediate location along the frame. The shaft 50 supports a rotor 52 of the rotary disc assembly on the outer end portion of the shaft which protrudes beyond the first end of the frame.

The rotor 52 comprises a circular plate mounted perpendicularly to the outer end of the shaft at a location spaced outwardly from the first end of the frame. The diameter of the plate forming the rotor is such that the peripheral edge of the rotor protrudes well below the bottom side of the frame for engaging into the ground and cutting into the soil in operation. For example, the diameter of the rotor may be three feet.

The rotary disc assembly further comprises a plurality of blades 54 mounted on the body of the rotor at circumferentially spaced apart positions. Each of the blades forms of a paddle having a main portion 100 which is generally perpendicular to the circumferential direction as well as protruding perpendicularly outwardly from the circular plate forming the rotor body. Each paddle is generally elongate in the radial direction from a central location on the rotor body to the peripheral edge thereof. In this manner, the blades are suited for cutting into the soil and for subsequently throwing the soil generally tangentially to the rotating rotor body.

More particularly, the plurality of blades 54 include a plurality of front blades 54A supported at a front side of the rotor and a plurality of rear blades 54B supported at a rear side of the rotor opposite from the front side of the rotor in a direction of the disc axis of the rotor. The rear blades 54B are all identical to one another while being smaller in radial length, surface area at the leading face, and overall size than the front blades 54A that are also identical to one another. In this manner, a collective area of leading faces of the front blades is greater than a collective area of leading faces of the rear blades.

As shown in the Figures, in addition to the main portion 100, each of the front and rear blades is also arranged to be generally cupped or concave at the leading side thereof. The main body portion 100 protrudes axially outward from the rotor face, generally in an axial direction from an inner end towards an outer end of the blade so as to be oriented transversely to the working direction of rotation of the rotor while protruding forwardly from the rotor in an axial direction. Each of the front and rear blades however further includes an outer portion 102 which is oriented transversely to the working direction of rotation of the rotor and extends forwardly from the main body portion generally in the axial direction so as to be angled to extend outwardly at slope leading into a direction of rotation of the rotor such that the outer end of the blade leads the inner end of the blade in the direction of rotation of the rotor, thus defining the cupped or concave shape at the leading side of each blade.

In this manner, when moving the attachment across the ground in a forward direction of the disc axis, by displacing the excavator along the ground, the outer portions 102 of the front blades will first engage the ground and the slope of the outer portions acts to pull the attachment forwardly into the ground by biting into the ground as the rotor rotates in the working direction 104. Similarly, when moving the attachment in an opposing rearward direction of the disc axis, the outer portions 102 of the rear blades will first engage the ground and the slope will similarly act to pull the attachment rearwardly into the ground. This arrangement minimizes requirements on the boom to push the rotating rotor forwardly or rearwardly through the ground, thus minimizes stress on the boom in operation.

A guard panel 56 is mounted on the attachment frame to extend in a generally circumferential direction partway about the periphery of the rotor 52. More particularly, the guard panel extends circumferentially through a range of approximately 90 degrees from an inner side of the frame towards the top side of the frame above the rotor.

The guard panel 56 includes an inner side portion 56A extending circumferentially about an inner side of the rotor in fixed relation to the frame, and an upper portion 56B extending circumferentially about a top side of the rotor of the rotary disc assembly respectively.

The upper portion 56B of the guard panel is pivotally mounted at an inner end to the top end of the inner side portion 56A for pivotal movement of the upper portion 56B about an axis at the inner end of the upper portion which is parallel to the disc axis. The opposing free outer end of the upper portion 56B is thus movable between a closed position in proximity to an outer side of the rotor and an open position spaced above the rotor such that the outer side of the rotor is substantially unobstructed by the upper portion of the guard panel in the open position. The upper portion 56B of the guard panel can be displaced and fixed at any one of a range of positions between the open and closed positions which controls the range that dirt can be thrown from the rotor. In normal operation, the upper portion 56B of the guard panel remains fully open so as to be typically oriented to extend laterally outward generally tangentially to the rotor 52 at an upward inclination.

A hydraulic actuator 62 is coupled between the frame and the upper portion 56B to controllably adjust the angle of the upper portion 56B relative to the frame. The hydraulic actuator is controlled by a hydraulic output of the implement and includes a quick coupler attachment connected in series therewith to permit ready separation of the hydraulic actuator from the hydraulic supply of the implement.

The attachment 10 further includes a drive motor 60 which is supported on the base member of the attachment frame in proximity to the second end thereof. The drive motor 60 is coupled to the disc rotor to drive the rotation thereof relative to the attachment frame. As illustrated, the drive motor 60 and the rotary disc assembly are spaced apart from one another in a direction of the disc axis so as to be situated on the attachment frame at axially opposing sides of the mounting bracket.

The working direction 104 that the rotor is driven to rotate corresponds to a bottom side of the rotor being displaced away from the inner side portion 56A of the guard panel. Accordingly the bottom side of the rotor rotates laterally outwardly away from the excavator.

Turning now to the second embodiment of FIGS. 1 to 7, in this instance, the drive motor comprises a hydraulic motor coupled to the drive shaft 50 of the rotary disc assembly in a direct drive configuration with a drive coupler 66 connected in series therebetween. The output of the hydraulic motor is again located coaxially with the shaft of the rotary disc assembly. The hydraulic motor includes a hydraulic input which includes quick couplers for ready connection to the hydraulic supply lines of the excavator implement while permitting ready separation of the hydraulic motor from hydraulic supply of the implement when detaching the rotary ditcher attachment from the excavator implement.

A variable control valve 106 is associated with the hydraulic input of the drive motor so as to be arranged to controllably vary a flow rate of the hydraulic supply of the implement so as to vary a speed of rotation of the rotor. A pressure relief valve 108 is also associated with the hydraulic input of the drive motor so as to be arranged to relieve pressure in the hydraulic supply of the implement above a prescribed upper pressure limit.

A resilient damper 110 is connected in series with a drive shaft connecting the drive motor to the rotary disc assembly to provide some resilience to partially absorb sudden shocks resulting from the rotor encountering different types of rocks and/or other debris in the ground during operation.

Figure 8:
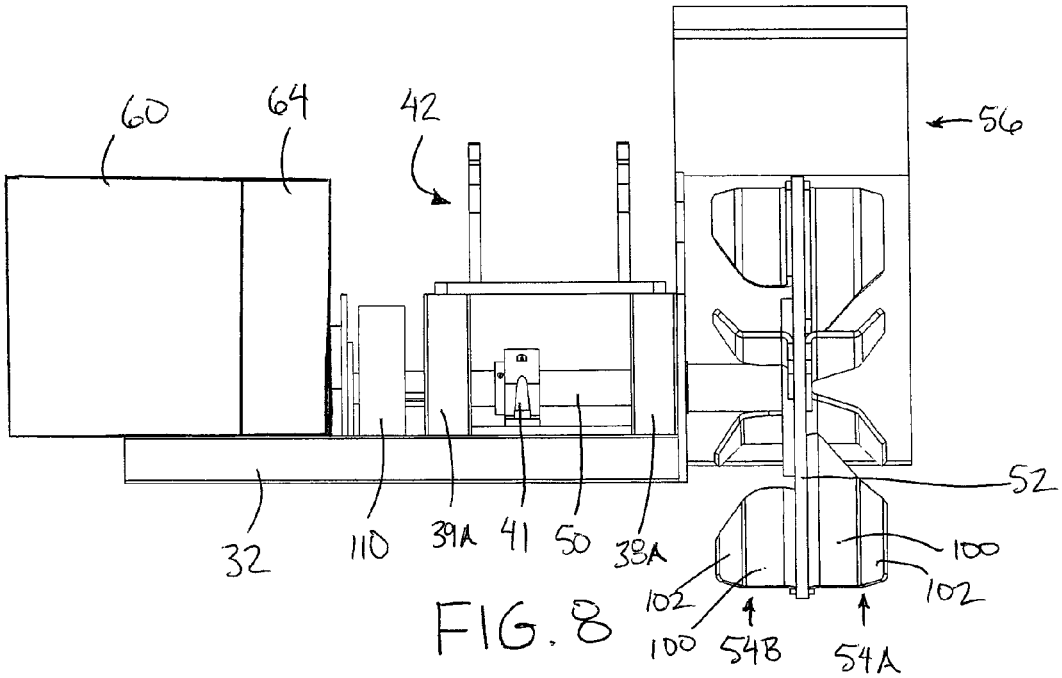
FIG. 8 is a side elevational view of a second embodiment of the rotary ditcher attachment.

In an alternative embodiment shown in FIG. 8, the drive motor 60 in this instance comprises an internal combustion engine supported at an axially spaced apart location relative to the rotor disc of the rotary disc assembly. The drive motor and the rotary disc body in this instance are axially spaced apart on opposing sides of the mounting bracket 42 therebetween. The drive motor is supported such that the output axis of the motor is substantially coaxial with the disc axis with the rotary disc assembly. A gearbox 64 is connected in series between the drive motor and the drive shaft 50 of the rotary disc assembly. The gearbox comprises a planetary reducer which is supported coaxially with the disc axis and the output of the motor.

Since various modifications can be made in my invention as herein above described, it is intended that all matter contained in the accompanying specification shall be interpreted as illustrative only and not in a limiting sense.

The invention claimed is:

1. A rotary ditcher attachment for an implement having an implement frame supported for movement along the ground, a boom extending between a first end pivotally supported on the implement frame and a second end opposite the first end, and a tool mount supported on the second end of the boom for supporting a ground engaging tool thereon, the rotary ditcher attachment comprising:

an attachment frame;

a mounting bracket supported on the attachment frame and arranged for releasable mounting onto the tool mount of the implement so as to be arranged to selectively suspend the attachment frame on the second end of the boom;

a rotary disc assembly comprising:

a rotor supported on the attachment frame for rotation relative to the attachment frame about a disc axis; and a plurality of blades supported on the rotor and arranged for cutting into the ground as the rotor is rotated; and a drive motor coupled to the rotor to drive rotation of the rotor relative to the attachment frame in a working direction of rotation, the drive motor being supported on the attachment frame so as to be releasable from the boom together with the attachment frame;

at least one of the blades comprising a cupped front blade having (i) a main body portion oriented transversely to the working direction of rotation of the rotor and protruding forwardly from the rotor in an axial direction, and (ii) an outer portion oriented transversely to the working direction of rotation of the rotor and extending forwardly from the main body portion generally in the axial direction at a slope relative to the main body portion leading into the working direction of rotation of the rotor such that the outer end of the cupped front blade leads the inner end of the cupped front blade in the working direction of rotation of the rotor;

whereby the outer portion of the at least one cupped front blade is arranged to bite into the ground to generate forces which pull the attachment frame forwardly into the ground when the rotor is rotated in said working direction of rotation and the attachment frame is displaced forwardly across the ground.

2. The rotary ditcher attachment according to claim 1 in combination with the implement in which the implement comprises an excavator and the tool mount is arranged to support an excavator bucket thereon, wherein the attachment frame of the rotary ditcher attachment is interchangeable with the excavator bucket on the tool mount.

3. The rotary ditcher attachment according to claim 1 in combination with the implement in which the tool mount of the implement is pivotal relative to the boom about a tool axis, wherein the attachment frame of the rotary ditcher is supported on the tool mount such that the attachment frame is pivotal with the tool mount relative to the boom about the tool axis and such that the disc axis is parallel to the tool axis.

4. The rotary ditcher attachment according to claim 1 further comprising a guard panel having an inner side portion and an upper portion supported on the attachment frame to extend circumferentially about an inner side and a top side of the rotor of the rotary disc assembly respectively, wherein the rotor is driven to rotate in a direction corresponding to a bottom side of the rotor being displaced away from the inner side portion of the guard panel.

5. The rotary ditcher attachment according to claim 4 wherein the upper portion of the guard panel is pivotal relative to the inner side portion and the attachment frame about an axis at an inner end of the upper portion such that an opposing free outer end of the upper portion is movable between a closed position in proximity to an outer side of the rotor and an open position spaced above the rotor such that the outer side of the rotor is substantially unobstructed by the upper portion of the guard panel.

6. The rotary ditcher attachment according to claim 1 further comprising a plurality of rear blades supported at to protrude rearwardly from the rotor at a rear side of the rotor opposite from a front side of the rotor that supports the at least one cupped front blade thereon, in which a collective area of leading faces of the front blades on the front side of the rotor is greater than a collective area of leading faces of the rear blades on the rear side of the rotor.

7. The rotary ditcher attachment according to claim 6 wherein each rear blade is smaller in size than each front blade on the front side of the rotor.

8. The rotary ditcher attachment according to claim 1 further comprising a plurality of rear blades supported at a rear side of the rotor opposite from the front side of the rotor that supports the at least one cupped front blade thereon, in which at least one of the rear blades comprises a cupped rear blade having (i) a main body portion oriented transversely to the working direction of rotation of the rotor and protruding rearwardly from the rotor the axial direction, and (ii) an outer portion oriented transversely to the working direction of rotation of the rotor and extending rearwardly from the main body portion generally in the axial direction at a slope relative to the main body portion leading into the working direction of rotation of the rotor such that the outer end of the cupped rear blade leads the inner end of the cupped rear blade in the direction of rotation of the rotor.

9. The rotary ditcher attachment according to claim 1 wherein the drive motor comprises a hydraulic motor coupled to the rotor, the hydraulic motor including a hydraulic input arranged to be coupled to a hydraulic supply of the implement, and wherein the hydraulic input includes couplers arranged to enable the hydraulic motor to be readily separated from the hydraulic supply of the implement.

10. The rotary ditcher attachment according to claim 9 further comprising a variable control valve associated with the hydraulic input of the drive motor so as to be arranged to controllably vary a flow rate of the hydraulic supply of the implement so as to vary a speed of rotation of the rotor.

11. The rotary ditcher attachment according to claim 9 further comprising a pressure relief valve associated with the hydraulic input of the drive motor so as to be arranged to relieve pressure in the hydraulic supply of the implement above a prescribed upper pressure limit.

12. The rotary ditcher attachment according to claim 1 wherein the drive motor comprises an internal combustion engine.

13. The rotary ditcher attachment according to claim 12 further comprising a gearbox connected in series between the drive motor and the rotary disc assembly.

14. The rotary ditcher attachment according to claim 13 wherein the gearbox comprises a planetary reducer connected coaxially with the disc axis and an output axis of the drive motor.

15. The rotary ditcher attachment according to claim 1 wherein the drive motor and the rotary disc assembly are spaced apart from one another in the axial direction of the rotor so as to be situated on the attachment frame at axially opposing sides of the mounting bracket.

16. The rotary ditcher attachment according to claim 1 further comprising a resilient damper connected in series with a drive shaft connecting the drive motor to the rotary disc assembly.

17. A rotary ditcher attachment for an implement having an implement frame supported for movement along the ground, a boom extending between a first end pivotally supported on the implement frame and a second end opposite the first end, and a tool mount supported on the second end of the boom for supporting a ground engaging tool thereon, the rotary ditcher attachment comprising:

an attachment frame;

a mounting bracket supported on the attachment frame and arranged for releasable mounting onto the tool mount of the implement so as to be arranged to selectively suspend the attachment frame on the second end of the boom;

a rotary disc assembly comprising:

a rotor supported on the attachment frame for rotation relative to the attachment frame about a disc axis;

a plurality of cupped front blades supported on a front side of the rotor and arranged for cutting into the ground as the rotor is rotated; and a plurality of cupped rear blades supported on a rear side of the rotor and arranged to cutting into the ground as the rotor is rotated; and a drive motor coupled to the rotor to drive rotation of the rotor in a working direction of rotation relative to the attachment frame, the drive motor being supported on the attachment frame so as to be releasable from the boom together with the attachment frame;

each cupped front blade having (i) a main body portion oriented transversely to the working direction of rotation of the rotor and protruding forwardly from the rotor in an axial direction, and (ii) an outer portion oriented transversely to the working direction of rotation of the rotor and extending forwardly from the main body portion generally in the axial direction at a slope relative to the main body portion leading into the working direction of rotation of the rotor such that the outer end of the cupped front blade leads the inner end of the cupped front blade in the working direction of rotation of the rotor;

each cupped rear blade having (i) a main body portion oriented transversely to the working direction of rotation of the rotor and protruding rearwardly from the rotor the axial direction, and (ii) an outer portion oriented transversely to the working direction of rotation of the rotor and extending rearwardly from the main body portion generally in the axial direction at a slope relative to the main body portion leading into the working direction of rotation of the rotor such that the outer end of the cupped rear blade leads the inner end of the cupped rear blade in the working direction of rotation of the rotor;

whereby the cupped front blades are arranged to bite into the ground to generate forces which pull the attachment frame forwardly into the ground when the rotor is rotated in said working direction of rotation and the attachment frame is displaced forwardly across the ground; and whereby the cupped rear blades are arranged to bite into the ground to generate forces which pull the attachment frame rearwardly into the ground when the rotor is rotated in said working direction of rotation and the attachment frame is displaced rearwardly across the ground.

18. The rotary ditcher attachment according to claim 17 wherein a collective area of leading faces of the cupped front blades is greater than a collective area of leading faces of the cupped rear blades.

* * * * *